US007998665B2

(12) United States Patent
Hansen

(10) Patent No.: US 7,998,665 B2
(45) Date of Patent: Aug. 16, 2011

(54) COLOR INTERMEDIATE MOTION PICTURE FILM

(75) Inventor: Jeffrey C. Hansen, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/719,227

(22) Filed: Mar. 8, 2010

(65) Prior Publication Data

US 2010/0167218 A1 Jul. 1, 2010

Related U.S. Application Data

(63) Continuation-in-part of application No. 12/339,486, filed on Dec. 19, 2008, now abandoned.

(51) Int. Cl.

| | |
|---|---|
| ***G03C 1/46*** | (2006.01) |
| ***G03C 1/494*** | (2006.01) |
| ***G03C 1/005*** | (2006.01) |
| ***G03C 7/32*** | (2006.01) |

(52) U.S. Cl. ..... 430/546; 430/502; 430/503; 430/504; 430/505; 430/506; 430/570; 430/572; 430/574; 430/576; 430/374; 430/390

(58) Field of Classification Search ..... 430/502–506, 430/546, 570, 572, 574, 576, 374, 390
See application file for complete search history.

(56) References Cited

U.S. PATENT DOCUMENTS

| | | | |
|---|---|---|---|
| 5,891,607 | A | 4/1999 | Brewer et al. |
| 6,093,526 | A | 7/2000 | Buitano et al. |
| 6,140,036 | A | 10/2000 | Parton et al. |
| 7,029,837 | B2 | 4/2006 | Fenton et al. |
| 7,368,230 | B2 | 5/2008 | Hosokawa et al. |

FOREIGN PATENT DOCUMENTS

| | | |
|---|---|---|
| EP | 1 818 719 | 8/2007 |

*Primary Examiner* — Geraldina Visconti
(74) *Attorney, Agent, or Firm* — J. Lanny Tucker

(57) ABSTRACT

Silver halide photographic elements that are color intermediate motion picture films have at least one green sensitive silver halide emulsion that includes a green sensitizing dye that is a cyanine dye having two oxazole groups in the molecule, and another green sensitizing dye having either two imidazole groups in the molecule or one oxazole group and one thiazole group in the molecule. The molar ratio of the first green sensitizing dye to the second green sensitizing dye is from about 4:1 to about 0.3:1. The magenta dye image forming unit has at least one green sensitive silver halide emulsion layer that comprises predominantly cubic silver iodobromide grains having at least 90 mol % bromide and at least 1 mol % iodide, which grains have an average equivalent spherical diameter (ESD) of less than 0.25 μm.

23 Claims, No Drawings

COLOR INTERMEDIATE MOTION PICTURE FILM

RELATED APPLICATION

This application is a Continuation-in-part of U.S. Ser. No. 12/339,486 that was filed Dec. 19, 2008 by Fenton and Hansen, which is now abandoned in favor of this application.

FIELD OF THE INVENTION

This invention relates to silver halide color silver halide films that have improved sensitivity to green light in certain emulsion layers. In particular, such elements are color intermediate motion picture films that can record digital images. The invention also relates to methods of providing images in such elements and to transferring those images to color motion picture print films.

BACKGROUND OF THE INVENTION

Color photographic elements are conventionally formed with superimposed blue, green, and red recording dye image-forming layer units coated on a support. These recording units contain radiation sensitive silver halide emulsion layers that can form a latent image in response to imaging blue, green, and red light, respectively. The silver halide layers include one or more suitable color dye-forming couplers that enable the latent image to be changed into a visible image. For example, the green-sensitive silver halide emulsion layers generally include one or more magenta dye-forming couplers.

Following imagewise exposure, a negative working photographic element is processed in a color developer that contains a color developing agent that is oxidized while selectively reducing to silver the latent image bearing silver halide grains. The oxidized color developing agent then reacts with the various dye-forming color couplers in the vicinity of the developed silver halide grains to product a visible color image. For example, the magenta dye-forming color couplers in the green recording layer units to form magenta dyes. Subsequently, the element is bleached (that is, silver is converted back to silver halide) to eliminate neutral density attributable to developed silver and then fixed (silver halide is removed) to provide stability during subsequent room light handling.

In the manufacture of a motion picture, a color motion picture film is generally used to record a "negative" image that is then printed on a motion picture intermediate film to provide a duplicate film. The image in the duplicate is then printed on a "positive" motion picture film that is used for projection.

In recent years, these processes have been converted from traditional optical exposing methods to digital exposing methods known in the industry as "writers" or "recorders" that use a computer and alternative writing devices (for example, lasers, cathode ray tubes or CRT's, and light emitting diodes or LED's). This provides greater options for manipulating and editing the various images during the multiple image transfers. For example, the original image can be captured using the negative motion picture films and the image can be digitized using a film scanner for transfer to the motion picture intermediate film. Alternatively, the original image can be captured using high definition video camera and transferred to the motion picture intermediate film. Existing motion picture films, originally designed for traditional exposing instrumentation, are not optimized for these new digital exposing devices such as laser, CRT's, or LED's.

EP 1,818,719A1 (Hosokawa et al.) describes motion picture films that can be used to record digital data in the process of making motion picture projection films.

U.S. Pat. No. 7,029,837 (Fenton et al.) describes color photographic elements that have a silver halide emulsion containing dual peek green sensitivity that is provided by a mixture of green spectral sensitizing dyes. However, this patent discloses methods to improve color reproduction in a camera speed film exposed with mixed illumination such that scenes are rendered more pleasing by balancing the spectral sensitivity to match the artificial lighting available. This is particularly beneficial with Tungsten or Daylight balanced films when the illumination has some fluorescent lighting. Fluorescent lights often contain select high intensity emission sources that over emphasize particular color wavelength regions of the spectral sensitivity spectrum. The teaching in this patent compensates for this over-enhanced spectral exposure by providing a green spectral distribution that selectively is less sensitive at the wavelengths where the emission lines are present.

U.S. Pat. No. 6,093,526 (Buitano et al.) describes color photographic films that have broadened green responsivity or sensitivity in at least one green-sensitive silver halide emulsion, which is provided by a specific combination of green spectral sensitizing dyes.

However, there is a need to improve the spectral sensitivity of intermediate motion picture films in the green light region of the electromagnetic spectrum, and that can be more effectively imaged using a broad range of commercial laser writing apparatus without loss in photospeed and other desired spectrophotometric properties

SUMMARY OF THE INVENTION

This invention provides a silver halide photographic element that is a color intermediate motion picture film designed for exposure by laser radiation, the element having an ISO film speed of 1 or less, and comprising a support having thereon:

a cyan dye image forming unit comprising at least one red sensitive silver halide emulsion, a magenta dye image forming unit comprising at least one green sensitive silver halide emulsion, and a yellow dye image forming unit comprising at least one blue sensitive silver halide emulsion, wherein the magenta dye image forming unit has at least one green sensitive silver halide emulsion layer that comprises predominantly cubic silver iodobromide grains having at least 90 mol % bromide, which grains have an average equivalent spherical diameter (ESD) of less than 0.25 μm, the green sensitive silver halide emulsion further comprising a first green sensitizing dye that is a cyanine dye having two oxazole groups in the molecule, and a second green sensitizing dye having either two imidazole groups in the molecule or one oxazole group and one thiazole group in the molecule, and the molar ratio of the first green sensitizing dye to the second green sensitizing dye is from about 4:1 to about 0.3:1.

This invention also provides a method of providing a color image comprising:

imagewise exposing the color intermediate motion picture film of this invention to laser radiation to provide a latent image, and developing the latent image in the presence of a color developing agent to provide a color image.

The present invention provides color intermediate motion picture films that are more sensitive in the green light region of the electromagnetic spectrum, and thus can be more effectively imaged using a broad range of commercial laser writing apparatus without loss in photospeed and other desired spectrophotometric properties. I have found that the films of this invention are particularly more sensitive at 530 nm using a combination of green sensitizing dyes that have maximum absorption at different wavelengths. It was also found unexpectedly that this combination of green sensitizing dyes improves photospeed ("speed") compared to the photospeed obtained with use of each dye individually, and that such increases in speed are possible with a reduced overall amount of green sensitizing dyes.

The present invention is directed to a different purpose than that described in U.S. Pat. No. 7,029,837 (noted above). In preferred embodiments, I add a second sensitizing dye such that the combination of green spectral sensitizing dyes actually enhances the speed performance in the spectral region of the laser light source. Furthermore, the noted patent targets the combination of dyes as a means to improve the color accuracy of the captured image in a camera speed film. The present invention seeks to improve color intermediate motion picture films that are not designed to have "camera speed".

In addition, the present invention differs significantly from the teaching in U.S. Pat. No. 6,093,526 (noted above). The primary difference is that the color negative photographic elements described in this patent are designed to be a camera speed image capture and storage devices. Camera speed films are typically classified by an ISO speed rating, and these speed ratings are typically between 6 and 6400. The ISO formula used is as follows:

$$ISO=1/H_m \text{ times } 0.8$$

wherein $H_m$ is the exposure in lux-seconds that gives a density of 0.10 above the base plus fog and 0.8 is a constant that introduces a safety factor of 1.2 into the resulting speed value. The film is actually 1.2 times faster than the published value, which guards against underexposure. See Photographic Materials and Processes; editors Leslie Storbel, John Compton, Ira Current, Richard Zakia, Butterworth Publishers, Stoneham, Mass. (1986), p 55).

Thus, application of camera speed films in the range of 6 to 6400, for image capture, are commonly limited to traditional consumer, amateur, and professional photography and motion picture photography where scene movement, either from subject motion or from that inadvertently generated by camera motion, is not a concern. An appropriate film speed is chosen to avoid degradation of fidelity of subject matter.

The present invention, however, is directed to color intermediate motion picture films that can not be utilized in a traditional camera film system as their film speeds are inherently too slow (ISO 1 or less). Color intermediate motion picture film capture systems differ from camera speed film capture systems in that they do not typically refer to the ISO speed rating. However, the application of the ISO formula (noted above) would generate an ISO film speed significantly less than 1 for the color intermediate motion picture films. Such films are clearly impractical for camera capture use, and are specifically designed for use in the industrial duplication processes for making high fidelity copies and prints for theatrical motion picture display.

Further differentiation of camera speed films and color intermediate motion picture films according to this invention reside in the type and grain sizes of the silver iodobromide emulsions used in the present invention. Camera speed films have significantly higher speeds and use a combination of silver halide emulsion morphologies that rely on high aspect ratio tabular emulsions to obtain the necessary higher speed. These high aspect ration emulsions typically have equivalent circular diameters (ECD's) of from 0.3 and up to 3 μm and thicknesses of less than 0.3 μm (more commonly between 0.06 to 0.15 μm).

In contrast, the color intermediate motion picture film emulsions used in the present invention are designed for high fidelity reproduction that strives to minimize any contribution of noise (grain) introduced by the film in the duplication process. As such, the emulsions are typically characterized by fine-grained silver iodobromide emulsions with equivalent spherical diameters (ESD) of less than 0.25 μm.

Furthermore, U.S. Pat. No. 6,093,526 (noted above) is focused on the importance of recording scene color accuracy in a manner that "accurately records light according to the human visual system". One described element for delivering this goal is the use of a preferred combination of green dyes that defines a broad spectral region. Such a spectral region is defined as 50 nm wide at 50% of the peak adsorption. Additionally, according to this patent, to achieve accurate color rendition, the use of color correction technology is relied upon in color negative and color reversal systems. The most common color negative technologies that achieve this goal are development inhibitor releasing (DIR) couplers that imagewise release development inhibitors to reduce the extent of development of the receiving silver halide grains. In the present invention, the color intermediate motion picture films contain no DIR couplers and the combination of green spectral sensitizing dyes is not designed to mimic the human visual system but to be useful in laser duplicating or printing. It is also desirable to have narrow green spectral sensitivity regions that have narrower regions that are well aligned with the exposing devices used in the industrial intermediate motion picture film writers or recorders.

DETAILED DESCRIPTION OF THE INVENTION

Unless otherwise indicated, the terms "photographic element", "element", "silver halide photographic element", "photographic film", and "color intermediate motion picture film" all refer to embodiments of the present invention.

In referring to "first" and "second" green sensitizing dyes, I mean different chemical classes and are not referring to a specific order of addition to the emulsion formulations.

The term "color coupler" refers to a compound that reacts with oxidized color developing agent to create or modify the hue of a dye chromophore. A color coupler may also be referred to as a "dye image-forming coupler".

In referring to blue, green, and red recording dye image-forming units, the term "layer unit" refers to the combination comprising one or more hydrophilic layers (such as silver halide emulsion layers) the contain radiation-sensitive silver halide grains to capture exposing radiation and color couplers that react upon development of such grains. The grains and couplers can be in the same or adjacent layers.

The term "development inhibitor releasing compound" or "DIR" refers to compounds that cleave to release a development inhibitor during color development, and "DIAR" refers to compounds that cleave to release a development inhibitor anchimerically that becomes active after a slight time delay, and thus allows molecular diffusion to help with layer selective inhibition.

In referring to grains and silver halides containing two or more halides, the halides are named in order of ascending concentrations.

"ESD" refers to "equivalent spherical diameter" that is a measure of the diameter of a sphere having the same projected volume as a silver halide grain.

The terms "blue spectral sensitizing dye", "green spectral sensitizing dye", and "red spectral sensitizing dye" refer to a dye or combination of dyes that sensitize silver halide grains, and when absorbed, have their peak absorption in the blue, green, and red regions of the electromagnetic spectrum, respectively. The terms "spectral sensitizing dye" and "sensitizing dye" are synonymous.

The term "absorbance peak" or "absorbance maximum" refers to a local maximum value of absorbance in a table or graph of data comprising absorbance values as a function of wavelength. An "absorbance peak" exists when the value of the absorbance is lower at wavelengths immediately less than and immediately greater than the wavelength of the absorbance peak.

Research Disclosure is published by Kenneth Mason Publications, Ltd., Dudley House, 12 North Street, Emsworth, Hampshire PO10 7DQ, England.

The spectral sensitivity distribution of a silver halide emulsion is representative of how the emulsion converts photons of absorbed radiation to developable latent image. It is conveniently displayed as a graph of photographic sensitivity (speed) versus wavelength of radiation. The light actually absorbed by a dyed emulsion in a gelatin coating on a support can be measured spectrophotometrically. Since silver halide grains scatter light, some light is transmitted by the coating, some light is reflected, and the remainder is absorbed. The absorbance of a coating of a silver halide emulsion is determined by measuring wavelength-by-wavelength the total amount of light transmitted, and the total amount of light reflected. The absorbance at each wavelength is then expressed as (1-T-R) wherein T is the amount of light transmitted and R is the amount of light reflected. The absorbance can be plotted as the percent of light absorbed vs. the wavelength. Silver halide also absorbs blue light, especially as the halide has increasing amounts of iodide.

A combination of sensitizing dyes on the surface of silver halide grains is generally equally efficient at all wavelengths at converting absorbed photons to conduction band elections.

The advantages of the present invention are achieved by using a unique combination of sensitizing dyes in one or more green-sensitive silver halide emulsion layers. The useful sensitizing dyes are selected from at least two chemical groups, and at least one sensitizing dye is chosen from each of the groups. While two specific classes of sensitizing dyes are described and used in this invention, the photographic film of this invention could also include additional green sensitizing dyes in the green-sensitive silver halide emulsion layers. The specific additional sensitizing dyes and useful amounts could be determined by a skilled worker using routine experimentation.

A first group of useful sensitizing dyes (including but not limited to, GSD-1 and GDS-2 described below) includes cyanine dyes each of which has two substituted or unsubstituted oxazole groups in the molecule. Typically, the oxazole groups are at opposite ends of a substituted or unsubstituted methine chain having 3 carbon atoms in the chain. Generally, each of such cyanine dyes has a maximum absorption at a wavelength of from about 515 to about 540 nm, and more particular from about 530 to about 534 nm.

A second class of useful green sensitizing dyes (including but not limited to GSD-3, GSD-6, and GSD-7 described below) are cyanine dyes each of which has either two substituted or unsubstituted imidazole groups in the molecule or one substituted or unsubstituted oxazole group and one substituted or unsubstituted thiazole group in the molecule. These heterocyclic groups are at opposite ends of a substituted or unsubstituted methine chain having 3 carbon atoms in the chain. Generally, each of such cyanine dyes has a maximum absorption at a wavelength of from about 500 to about 600 nm, or typically from about 530 to about 570 nm, and more particularly from about 559 to about 565 nm.

Each of the first and second green sensitizing dyes can be present individually in the photographic film in an amount of from about $5\times10^{-4}$ to about $1.5\times10^{-2}$ mol/m$^2$.

The molar ratio of the first green sensitizing dye to the second green sensitizing dye is from about 4:1 to about 0.3:1 or typically from about 3:1 to about 1.5:1.

In some embodiments of this invention, the magenta dye image forming unit comprises two or more green sensitive silver halide emulsion layers. In such embodiments, one or more of the emulsion layers can have at least one of each of the first and second green sensitizing dyes, in the same or different molar ratios. In other embodiments, each of the green sensitive silver halide emulsion layer (two or more) has the same combination of first and second green sensitizing dyes in the same or different molar ratios, and typically at the same molar ratios.

The first and second green sensitizing dyes can be present in the various emulsion layers at the same molar ratio or at different molar ratios that a skilled worker can adjust for a particular spectrophotometric result.

In some embodiments, at least one green sensitive silver halide emulsion consists essentially of only one first green sensitizing dye that is a cyanine dye having two oxazole groups in the molecule, and only one second green sensitizing dye having either two imidazole groups in the molecule or one oxazole group and one thiazole group in the molecule.

Some useful specific useful green sensitizing dyes include at least one of the following compounds GSD-1 and GSD-2:

GSD-1

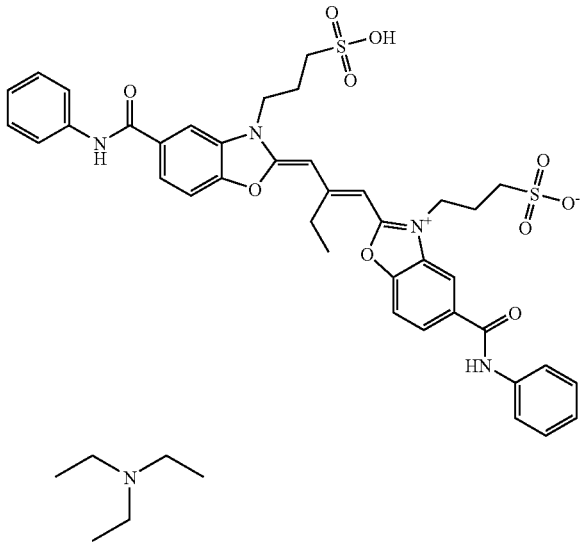

-continued

GSD-2

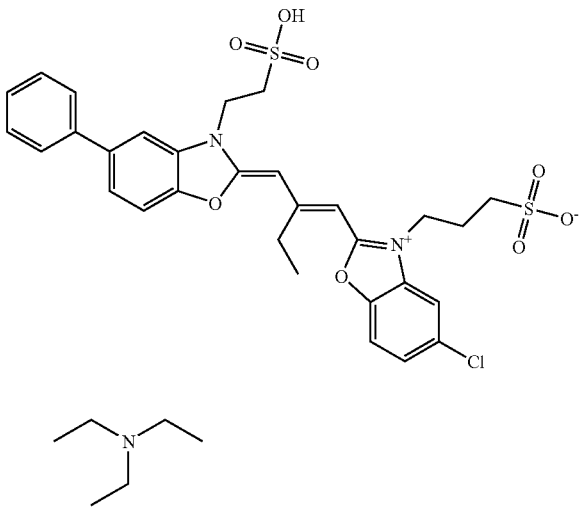

and further comprise at least one of the following compounds GSD-3, GSD-6, and GSD-7:

GSD-3

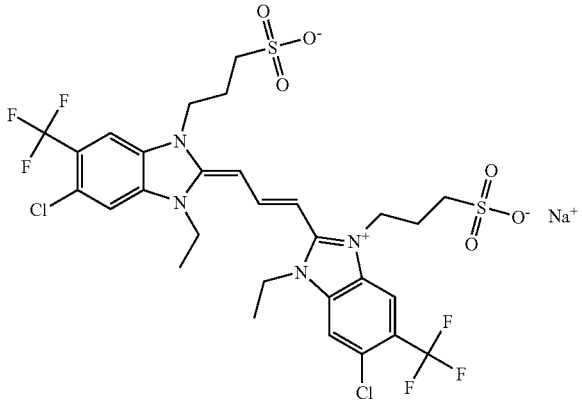

GSD-6

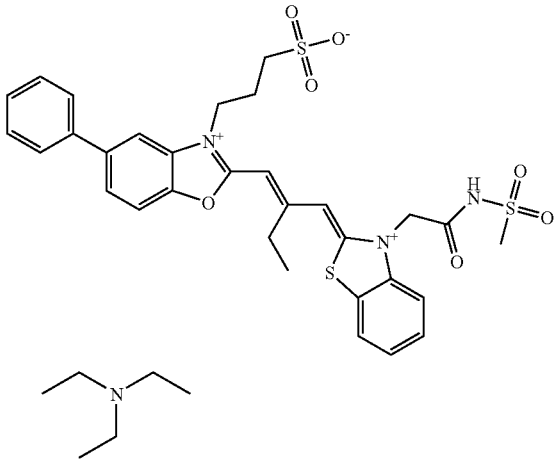

-continued

GSD-7

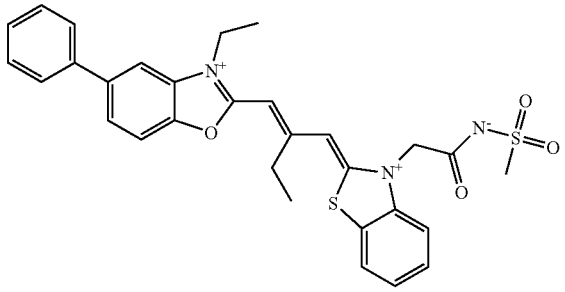

The first and second sensitizing dyes described herein can be prepared by known processes using known starting materials.

For example, the sensitizing dyes can be added to the silver halide by premixing them as a solution in a suitable solvent, as a mixed dispersion in gelatin, or as a mixed liquid crystalline dispersion in water. The mixture of sensitizing dyes can be added to the silver halide emulsion grains and hydrophilic colloid at any time prior to or simultaneously with the application of the emulsion coating solution to a support. The sensitizing dyes can be added prior to, during, or following the chemical sensitization of the emulsion grains.

The photographic elements of this invention are multicolor elements containing dye image forming units sensitive to each of the three primary regions of the spectrum. Each of these units comprises one or more silver halide emulsion layers sensitive to the given spectral region. The layers of the element, including the layers of the dye image forming units, can be arranged in various orders as known in the art depending upon their use (for example, motion picture intermediate films). Generally, the dye image forming units are arranged so that they have this order from the support to the outer film surface: yellow dye image forming unit, magenta due image forming unit, and cyan dye image forming unit.

Generally, the photographic elements comprise a support having thereon a cyan dye image forming unit comprising one or more red-sensitive silver halide emulsion layers having associated therewith one or more cyan dye-forming color couplers, a magenta dye image forming unit comprising one or more green-sensitive silver halide emulsion layers having associated therewith one or more magenta dye-forming color couplers, and a yellow dye image forming unit comprising one or more blue-sensitive silver halide emulsion layers having associated therewith one or more yellow dye-forming color couplers. The element can also contain other layers such as filter dye layers, interlayers, overcoat layers, antihalation layers, underlayers, subbing layers, and others known in the art. By "associated", I mean that the reactive compound (for example color coupler) is in or adjacent to a specified layer where, during processing, it is capable of reacting with other components.

In the following discussion of components useful in the photographic elements, reference will be made to Research Disclosure, September 1996, Item 38957 that will be identified hereafter as "Research Disclosure". The contents of this publication and the publications cited therein are incorporated herein by reference. In addition, U.S. Pat. No. 7,029,837 (Fenton et al.) will be referenced and identified hereafter as "US '837".

The silver halide emulsions used in the photographic elements are negative working and useful as color intermediate motion picture films.

Other than the combination of green sensitive sensitizing dyes described above, useful emulsions, their preparation, and methods of chemical and spectral sensitization are described in Sections I though V of Research Disclosure. Various additives such as UV dyes, brighteners, antifoggants, stabilizers, light absorbing and scattering materials, and physical property modifying addenda such as hardeners, coating aids, plasticizers, lubricants, and matting agents are described for example in Sections II and VI through VIII. Color materials are described in Sections X through XIII. Suitable methods for incorporating color couplers and dyes, including dispersions in organic solvents, are described in Section X (E). Scan facilitating is described in Section XIV. Supports, exposure, development systems, and processing methods and agents are described I Section XV to XX.

Useful yellow, cyan, and magenta color couplers and amounts for their use are described for example in US '837, Cols. 20 through 21. Other useful components such as bleach accelerator releasing couplers and filter dyes are described in US '837, Cols. 21-26. The photographic elements of this invention contain no development-inhibitor-releasing (DIR) compounds and no development-inhibitor-anchiomeric-releasing (DIAR) compounds.

The silver halide used in the photographic elements can be silver iodobromide, silver bromide, silver iodochlorobromide, and silver chloroiodobromide, and the silver halide emulsion layers in the elements can have the same or different silver halide grains. The amount of bromide in the grains of such emulsions is generally at least 90 mol %, and the amount of iodide can be at least 1 mol % and up to and including 10 mol %. However, in most embodiments, the amount of iodide is from about 2 to about 8 mol %.

The green sensitive silver halide emulsion layers comprise predominantly cubic silver iodobromide grains.

In some embodiments, the silver halide photographic element of the invention has a magenta dye image forming unit that comprises at least two different green sensitive silver halide emulsion layers, a first emulsion layer that is arranged to be the first green sensitive silver halide emulsion layer that is exposed by imaging radiation (that is, the green sensitive silver halide emulsion layer farthest from the support). This first emulsion layer has predominantly cubic silver iodobromide grains having at least 90 mol % bromide (or typically at least 95 mol %), and a second emulsion layer (closer to the support) having predominantly cubic silver iodobromide grains having at least 90 mol % bromide (or typically at least 95 mol %), wherein the average ESD for both layers is less than 0.25 μm or particularly less than 0.2 μm), but the average ESD for the first emulsion layer is greater than the average ESD for the second emulsion layer (generally by at least 0.02 μm).

For example, in some silver halide photographic elements, the cubic silver iodobromide grains in the first emulsion layer have an average ESD between 0.14 and 0.25 μm, and the silver iodobromide cubic grains in the second emulsion layer have an average ESD between 0.10 and 0.14 μm.

Still further, the magenta dye forming unit can further comprise a third green sensitive silver halide emulsion layer that is closer to the support than the first and second silver halide emulsion layers, and that has predominantly cubic silver iodobromide grains having at least 90 mol % (typically at least 95 mol %) bromide and an average ESD between 0.06 and 0.12 μm.

When there are two or more green sensitive silver halide emulsion layers in the photographic element, the layers have progressively greater photographic speed as the layers are arranged away from the support and closer to the film outer surface. Generally, this difference in photographic speed is obtained by providing different silver halide emulsions with differing average ESD for the cubic silver iodobromide grains. There may be, however, a mixture of types of cubic grains in each silver halide emulsion layer with different average ESD and composition, as long as the predominant (at least 50 weight %) of the silver halide grains in each green sensitive silver halide emulsion layer has cubic grains having at least 90 mol % bromide and at least 1 mol % iodide.

For example, any of the green sensitive silver halide emulsion layers as described above can additional have cubic silver iodobromide grains having an average ESD of between 0.05 and 0.20, which grains can have up to 10 mol % iodide, or particular 1 to 5 mol % iodide.

In most embodiments, all of the green sensitive silver halide emulsion layers comprise predominantly (greater than 50 weight % of all grains) cubic silver iodobromide grains having at least 95 mol % bromide.

In addition, it is possible that all of the silver halide emulsion layers in all image forming units comprise predominantly (greater than 50 weight % of all grains) cubic silver iodobromide grains having at least 90 mol % bromide.

The silver halide photographic elements of this invention have an ISO film speed of less than 1, or from 0.1 to 0.7. ISO is a known standard in the industry as described above. Camera speed films known in the art generally have an ISO film speed greater than 5, and more likely greater than 50.

The silver halide grains can be prepared using methods known in the art such as those described in Section I of Research Disclosure and in *The Theory of the Photographic Process*, James (Ed.), Macmillan Publishing Co. New York, 1977. Dopants can also be used to modify grain features.

The silver halide grains are also spectrally sensitized as described above using the appropriate spectral sensitizing dyes for the desired sensitivity to exposing radiation. Further details about spectral sensitization are provided in Section V of Research Disclosure.

The photographic elements can be exposed to suitable actinic imaging radiation including laser radiation to form a latent image that is then processed using a suitable color developer containing a color developing agent (such as a p-phenylenediamine) to provide a visible dye image. For example, imaging can be carried out using an ARRILASER Model HD/DI laser recording device or a CELCO FIRESTORM cathode-ray tube recorder.

The processing step(s) produces a negative image. High speed is generally desired to provide a sufficient image in such films. If the color negative element is subsequently used to generate a viewable projection print as for a motion picture, a process such as Kodak ECN-2 described in the H-24 Manual that is standard in the industry, can be used to provide a color negative image on a transparent support. Processing times and temperatures are well known.

The method of this invention can further comprise transferring the color image in the color intermediate motion picture film obtained from the imaging and development described above, to a color motion picture print film. This can be done, for example, by exposing the color motion picture print film through the imagewise exposed and developed color intermediate motion picture film.

The following examples are intended to illustrate the practice of this invention and not to be used to limit it in any manner. In addition, the features and components of the photographic elements described herein can be used in any desired combination. Coating coverage is reported in terms of $g/m^2$ except as otherwise indicated. Silver halide coating coverage is reported in terms of silver.

Example 1

Single-Layer Photographic Film

Photographic samples 101 through 124 were prepared. For all samples, emulsion A, a silver bromoiodide, iridium-doped, emulsion with an iodide content of 3.3 mole percent, based on silver, was used. The mean equivalent spherical diameter of the emulsion was 0.087 μm with a nominal cubic edge length of 0.070 μm.

Emulsion A was melted and stirred consistent with practices common in the art. The melted emulsion was sensitized using the disodium salt of 5,5'(dithiobis(4,1,-phenylene-imino))bis(5-oxo-pentanoic acid) at 15 mg/mole of silver, sodium thiosulfate pentahydrate at 128 mg/mole of silver, sodium aurous(I) dithiosulfate dihydrate at 256 mg/mole of silver, and 2-benzoxaxolamine, N-2-propynyl- at 6 mg/mole of silver. Following the chemical additions, the emulsion was subjected to a heat treatment for 15 minutes at 63.8° C. in a manner common in the art.

TABLE 1-1

| Sample Number (Inventive/ Comparative) | Dyes Used (Solvent) | Dye Quantity % Molar Ratio ($\times 10^{-3}$ of Dye moles) | Component |
|---|---|---|---|
| 101 (Comp) | GSD-1 (LCS) | 0.5 | 100 |
| 102 (Comp) | GSD-1 (LCS) | 1.0 | 100 |
| 103 (Comp) | GSD-2 (Me) | 1.0 | 100 |
| 104 (Comp) | GSD-3 (LCS) | 1.0 | 100 |
| 105 (Comp) | GSD-4 (LCS) | 1.0 | 100 |
| 106 (Comp) | GSD-5 (LCS) | 1.0 | 100 |
| 107 (Comp) | GSD-6 (LCS) | 1.0 | 100 |
| 108 (Comp) | GSD-7 (LCS) | 1.0 | 100 |
| 109 (Inv) | GSD-1 (LCS)/GSD-3 (LCS) | 1.0 | 50:50 |
| 110 (Comp) | GSD-1 (LCS)/GSD-4 (LCS) | 1.0 | 50:50 |
| 111 (Comp) | GSD-1 (LCS)/GSD-5 (LCS) | 1.0 | 50:50 |
| 112 (Inv) | GSD-1 (LCS)/GSD-6 (LCS) | 1.0 | 50:50 |
| 113 (Inv) | GSD-1 (LCS)/GSD-7 (LCS) | 1.0 | 50:50 |
| 114 (Inv) | GSD-1 (LCS)/GSD-3 (LCS) | 1.0 | 80:20 |
| 115 (Inv) | GSD-1 (LCS)/GSD-3 (LCS) | 1.0 | 60:40 |
| 116 (Inv) | GSD-1 (LCS)/GSD-3 (LCS) | 1.0 | 40:60 |
| 117 (Inv) | GSD-1 (LCS)/GSD-3 (LCS) | 1.0 | 20:80 |
| 118 (Inv) | GSD-1 (LCS)/GSD-3 (LCS) | 1.42 | 70:30 |
| 119 (Inv) | GSD-1 (Me)/GSD-3 (LCS) | 1.42 | 70:30 |
| 120 (Inv) | GSD-2 (Me)/GSD-3 (LCS) | 1.42 | 70:30 |
| 121 (Comp) | GSD-1 (LCS)/GSD-4 (LCS) | 1.42 | 70:30 |
| 122 (Comp) | GSD-1 (LCS)/GSD-5 (LCS) | 1.42 | 70:30 |
| 123 (Inv) | GSD-1 (LCS)/GSD-6 (LCS) | 1.42 | 70:30 |
| 124 (Inv) | GSD-1 (LCS)/GSD-7 (LCS) | 1.42 | 70:30 |

Following the heat treatment procedure, samples were returned to 43.3° C. and green spectral sensitizing dyes (GSD-1 through GSD-7) were added singly or sequentially as described in TABLE 1-1. Sample 101 was sensitized with $0.50\times10^{-3}$ moles of dye/mole of silver and samples 102 through 108 were sensitized with $1.00\times10^{-3}$ moles of dye/mole of silver. Samples 109 through 124 had two dyes added sequentially having molar ratios and total moles of dye as summarized in TABLE 1-1. All samples were held for 10 minutes after each dye addition. Dyes were prepared either as aqueous liquid crystalline suspensions (LCS) or dissolved in methanol (Me) as indicated in TABLE 1-1. After the dye addition and requisite hold time, 6-bromo-5-methyl-1,2,4-triazolo[1,5-a]pyrimidin-7-ol at 5 g/mole of silver and gelatin at 56.5 g/mole of silver were added to all samples. Samples were subjected to a final heat treatment at 60° C. for 5 minutes before returning to 35° C. and dibromide 3,3'-(1,10-decanediyl) bis-benzothiazolium at 40 mg/mole of silver was added.

Example 2

Photographic samples 125 through 141 were prepared. For all samples, emulsion A, a silver bromoiodide, iridium-doped, emulsion with an iodide content of 3.3 mole percent, based on silver, was used. The mean equivalent spherical diameter of the emulsion was 0.087 μm with a nominal cubic edge length of 0.070 μm.

Emulsion A was melted and stirred consistent with practices common in the art. The melted emulsion was sensitized using the disodium salt of 5,5'-(dithiobis(4,1,-phenylene-imino))bis(5-oxo-pentanoic acid) at 15 mg/mole of silver, followed by the addition of GSD-1 through GSD-7 singly or sequentially as described in TABLE 1-2. Samples 125-128 were sensitized with a single dye. Samples numbered 129 through 134 used two dyes added sequentially having a molar ratio of 50:50 for a total dye amount of $1.00\times10^{-3}$ moles of dye/mole of silver. Samples 135 through 140 were similar but contained a total dye amount of $1.40\times10^{-3}$ moles of dye/mole of silver. Sample 141 had $1.42\times10^{-3}$ moles of dye/mole of silver and a molar ratio of 70:30. All samples were held for 10 minutes after each dye addition. Dyes were dissolved in either methanol (Me) or prepared as an aqueous liquid crystalline suspension (LCS) as indicated in TABLE 1-2 below.

After the addition of the dyes, sodium thiosulfate pentahydrate at 128 mg/mole of silver and sodium aurous(I) dithiosulfate dihydrate at 256 mg/mole of silver were added sequentially. Following the chemical additions, the emulsion was subjected to a heat treatment for 15 minutes at 63.8° C. in a manner common in the art. After the heat treatment, the examples were returned to a temperature 43.3° C. 6-Bromo-5-methyl-1,2,4-triazolo[1,5-a]pyrimidin-7-ol at 5 g/mole of silver and gelatin at 56.5 g/mole of silver were added to all samples. The samples were subjected to a final heat treatment at 60° C. for 5 minutes before returning to 35° C. and dibromide 3,3'-(1,10-decanediyl) bis-benzothiazolium at 40 mg/mole of silver was added.

TABLE 1-2

| Sample Number (Inventive/ Comparative) | Dyes Used (Solvent) | Dye Quantity Molar Ratio ($\times 10^{-3}$ of Dye moles) | Component |
|---|---|---|---|
| 125 (Comp) | GSD-1 (LCS) | 0.5 | 100 |
| 126 (Comp) | GSD-2 (Me) | 0.5 | 100 |
| 127 (Comp) | GSD-1 (LCS) | 0.7 | 100 |
| 128 (Comp) | GSD-1 (Me) | 1.0 | 100 |
| 129 (Inv) | GSD-1 (LCS)/GSD-3 (LCS) | 1.0 | 50:50 |
| 130 (Comp) | GSD-1 (LCS)/GSD-4 (LCS) | 1.0 | 50:50 |
| 131 (Comp) | GSD-1 (LCS)/GSD-5 (LCS) | 1.0 | 50:50 |
| 132 (Inv) | GSD-1 (LCS)/GSD-6 (LCS) | 1.0 | 50:50 |
| 133 (Inv) | GSD-1 (LCS)/GSD-7 (LCS) | 1.0 | 50:50 |
| 134 (Inv) | GSD-2 (Me)/GSD-3 (LCS) | 1.0 | 50:50 |
| 135 (Inv) | GSD-1 (LCS)/GSD-3 (LCS) | 1.4 | 50:50 |
| 136 (Comp) | GSD-1 (LCS)/GSD-4 (LCS) | 1.4 | 50:50 |
| 137 (Comp) | GSD-1 (LCS)/GSD-5 (LCS) | 1.4 | 50:50 |
| 138 (Inv) | GSD-1 (LCS)/GSD-6 (LCS) | 1.4 | 50:50 |
| 139 (Inv) | GSD-1 (LCS)/GSD-7 (LCS) | 1.4 | 50:50 |
| 140 (Inv) | GSD-1 (Me)/GSD-3 (LCS) | 1.4 | 50:50 |
| 141 (Inv) | GSD-1 (Me)/GSD-3 (LCS) | 1.42 | 70:30 |

Example 3

Emulsion B, a silver bromoiodide, iridium-doped, emulsion with an iodide content of 3.3 mole percent, based on silver, was used. The mean equivalent spherical diameter of the emulsion was 0.165 μm with a nominal cubic edge length of 0.133 μm. Emulsion B was sensitized in a manner identical to Sample 118 but with component levels consistent with the grain size and common in the art to achieve multilayer performance.

Example 4

Emulsion C, a silver bromoiodide, iridium-doped, emulsion with an iodide content of 3.3 mole percent, based on silver, was used. The mean equivalent spherical diameter of the emulsion was 0.132 μm with a nominal cubic edge length of 0.120 μm. Emulsion C was sensitized in a manner identical to Sample 118 but with component levels consistent with the grain size and common in the art to achieve multilayer performance.

Example 5

Emulsion D, a silver bromoiodide, iridium-doped, emulsion with an iodide content of 3.3 mole percent, based on silver, was used. The mean equivalent spherical diameter of the emulsion was 0.087 μm with a nominal cubic edge length of 0.070 μm. Emulsion D was sensitized in a manner identical to Sample 118 but with component levels consistent with the grain size and common in the art to achieve multilayer performance.

Example 6

Emulsion E, a silver bromoiodide, iridium-doped, emulsion with an iodide content of 3.3 mole percent, based on silver, was used. The mean equivalent spherical diameter of the emulsion was 0.072 μm with a nominal cubic edge length of 0.058 μm. Emulsion E was sensitized in a manner identical to Sample 118 but with component levels consistent with the grain size and common in the art to achieve multilayer performance.

A transparent film support of cellulose triacetate with conventional subbing layers was provided for coated examples. The side of the support to be emulsion coated received an undercoat layer of gelatin. The reverse side of the support was comprised of dispersed carbon pigment in a non-gelatin binder (Rem Jet).

The coated examples were prepared by applying the following layers in the sequence set out below to the support. Hardener H-1 (bis(vinylsulfonyl)methane) was include at the time of the coating at 1.75 percent by weight of total gelatin, including the undercoat, but excluding the previously hardened gelatin subbing-layer forming part of the support. Surfactant was also added to the various layers as is commonly practiced in the art.

| Coated Element | |
|---|---|
| Layer 1: Light Sensitive Layer ($g/m^2$) | |
| Sensitized Emulsion Silver | (0.69) |
| Color Dye Forming Coupler C-1 | (0.75) |
| Gelatin | (2.15) |
| Layer 2: Gelatin Overcoat and Matte Beads ($g/m^2$) | |
| Gelatin | (1.08) |
| Matte Beads | (0.015) |

The dispersed carbon pigment on the backside of the coated elements was removed with methanol to determine the spectral absorbance. The light transmittance and reflectance of the sample was measured using a spectrophotometer over the visible range [350 nanometers (nm) to 700 nm]. The total reflectance [R(0)] is the fraction of light reflected from the coating measured with an integrating sphere, which includes all light exiting the coating regardless of angle. The total transmittance [T(0)] is the fraction of light transmitted through the coating regardless of angle. The total absorbance [A(0)] of the coating is determined from the measured total reflectance and total transmittance using the equation $A(0)=1-T(0)-R(0)$. The absorbance A(0) at 530 nm was generated by integrating only those data within +/−5 nm of 530 nm.

The relative performance of these coated elements was determined by exposure with three different light sources to determine spectral and intrinsic sensitivity to actinic radiation across the spectral region of interest. The light source employed are (i) a 25 milliWatts (mW) 532 nm green diode laser (CrystaLaser—Model number GCL-025-S-0.25%) with modulated intensity to generate a characteristic curve, (ii) a Mercury (Hg) vapor emission line at 365 nm, and (iii) a Tungsten lamp with a double monochrometer for selective spectral exposure (5 nm increments from 400 to 700 nm). The latter two used an exposure step tablet for generating a characteristic curve. Subsequent to exposure, the coated elements were processed through standard Kodak ECN-2 processing for minutes, 15 seconds and the optical densities of the exposure patches were measured.

A Speed Factor term is defined as the ratio of the photographic sensitivity of the primary green sensitizing dye (GSD-1 or GSD-2) to that of the dye combinations (for example, either of GSD-1 or GSD-2 with any of GSD-3 through GSD-7). A Speed Factor term near 1.0+/−0.1 indicates minimal or no enhanced performance. A Speed Factor term greater than 1.2 indicates improved performance with respect to the single dye. Desirably, the Speed Factor is greater than 1.5.

TABLE 1-3

| Sample Number (Inventive/ Comparative) | 365 nm Sensitivity (rel spd 1.0 Den) | Speed Factor | 532 nm Laser Sensitivity (rel speed @ 1.0 Den) | Speed Factor | λ max (nm) | Light Absorption @ 530 +/− 5 nm (log A(0)) |
|---|---|---|---|---|---|---|
| 101 (Comp) (Ref. GSD-1a) | 615 | Ref | 1803 | Ref | 532 | 1.57 |
| 109 (Inv) | 1133 | 1.8 | 3411 | 1.9 | 532 | 1.56 |
| 110 (Comp) | 644 | 1.0 | 2062 | 1.1 | 532 | 1.60 |
| 111 (Comp) | 634 | 1.0 | 1678 | 0.9 | 532 | 1.57 |
| 112 (Inv) | 891 | 1.4 | 2685 | 1.5 | 532 | 1.57 |
| 113 (Inv) | 1117 | 1.8 | 3467 | 1.9 | 532 | 1.57 |
| 114 (Inv) | 1047 | 1.7 | 4364 | 2.4 | 532 | 1.69 |
| 115 (Inv) | 1122 | 1.8 | 3715 | 2.1 | 532 | 1.61 |
| 116 (Inv) | 1186 | 1.9 | 2923 | 1.6 | 532 | 1.50 |

TABLE 1-3-continued

| Sample Number (Inventive/ Comparative) | 365 nm Sensitivity (rel spd 1.0 Den) | Speed Factor | 532 nm Laser Sensitivity (rel speed @ 1.0 Den) | Speed Factor | λ max (nm) | Light Absorption @ 530 +/− 5 nm (log A(0)) |
|---|---|---|---|---|---|---|
| 117 (Inv) | 1194 | 1.9 | 2089 | 1.2 | 560* | 1.35 |
| 102 (Comp) (Ref. GSD-1b) | 646 | Ref | 2612 | Ref | 532 | 1.74 |
| 118 (Inv) | 1033 | 1.6 | 4886 | 1.9 | 532 | 1.76 |
| 119 (Inv) | 1047 | 1.6 | 4785 | 1.8 | 532 | 1.75 |
| 121 (Comp) | 561 | 0.9 | 2735 | 1.0 | 532 | 1.81 |
| 122 (Comp) | 591 | 0.9 | 2529 | 1.0 | 532 | 1.76 |
| 123 (Inv) | 818 | 1.3 | 4045 | 1.5 | 532 | 1.77 |
| 124 (Inv) | 991 | 1.5 | 4908 | 1.9 | 532 | 1.75 |
| 103 (Comp) (Ref GSD-2a) | 740 | Ref | 234 | Ref | 520 | 0.83 |
| 120 (Inv) | 1030 | 1.4 | 738 | 3.2 | 560* | 1.05 |

*Spectral absorptivity of Ex. 110 and 117 are dominated by GSD-3 in the blend of GSD-2 and GSD-3

TABLE 1-4

| Sample Number (Inventive/ Comparative) | 365 nm Sensitivity (rel spd 1.0 Den) | Speed Factor | 532 nm Laser Sensitivity (rel speed @ 1.0 Den) | Speed Factor | λ max (nm) | Light Absorption @ 530 +/− 5 nm (log A(0)) |
|---|---|---|---|---|---|---|
| 125 (Comp) (Ref. GSD-1c) | 100 | Ref | 878 | Ref | 530 | 1.50 |
| 129 (Inv) | 551 | 5.5 | 1633 | 1.9 | 532 | 1.56 |
| 130 (Comp) | 107 | 1.1 | 914 | 1.0 | 532 | 1.61 |
| 131 (Comp) | 114 | 1.1 | 885 | 1.0 | 530 | 1.56 |
| 132 (Inv) | 327 | 3.3 | 1040 | 1.2 | 532 | 1.56 |
| 133 (Inv) | 530 | 5.3 | 1213 | 1.4 | 532 | 1.57 |
| 126 (Comp) (Ref. GSD-2b) | 123 | Ref | 100 | Ref | 520 | 0.42 |
| 134 (Inv) | 789 | 5.3 | 296 | 3.0 | 560* | 1.31 |
| 127 (Comp) (Ref. GSD-1d) | 100 | Ref | 1069 | Ref | 532 | 1.62 |
| 135 (Inv) | 620 | 6.2 | 2197 | 2.0 | 532 | 1.69 |
| 136 (Comp) | 113 | 1.1 | 1179 | 1.1 | 532 | 1.73 |
| 137 (Comp) | 104 | 1.0 | 1122 | 1.0 | 532 | 1.72 |
| 138 (Inv) | 389 | 3.9 | 1414 | 1.3 | 532 | 1.69 |
| 139 (Inv) | 475 | 4.8 | 1733 | 1.6 | 532 | 1.68 |
| 140 (Inv) | 604 | 6.0 | 2147 | 2.0 | 532 | 1.68 |
| 128 (Comp) (Ref GSD-1e) | 115 | Ref | 1160 | Ref | 532 | 1.78 |
| 141 (Inv) | 518 | 4.5 | 2316 | 2.0 | 532 | 1.79 |

*Spectral absorptivity of Sample 134 is dominated by GSD-3 in the blend of GSD-2 and GSD-3.

TABLE 1-3 shows samples of both the reference base dye performance as well as the performance of the inventive samples and comparative samples of dyes that did not show improvement. Sample 101 uses exclusively GSD-1 (as described in TABLE 1-1) and is the internal reference for samples 109-117 inclusive that have dye combinations. Sample 102 uses exclusively GSD-1 (as described in TABLE 1-1) and is the internal reference example for samples 118-124 inclusive that have dye combinations. Sample 103 uses exclusively GSD-2 (as described in TABLE 1-1) and is the internal reference for sample 120 that has a dye combination. In all cases, the comparative examples do not show an advantage and therefore have SPEED FACTOR values near 1.0. The inventive samples show and an advantage and have SPEED FACTOR values significantly greater than 1.0.

TABLE 1-4 shows samples of both the reference base dye performance as well as the performance of the inventive samples and comparative samples of dyes that did not show improvement. Sample 125 uses exclusively GSD-1 (as described in TABLE 1-2) and is the internal reference for samples 129-133 inclusive that have dye combinations. Sample 126 uses exclusively GSD-2 (as described in TABLE 1-2) and is the internal reference for samples 134 that has a dye combination. Sample 127 uses exclusively GSD-1 (as described in TABLE 1-2) and is the internal reference for samples 135-140 that have dye combinations. Example 128 uses exclusively GSD-1 (as described in TABLE 1-2) and is the internal reference for sample 141 that has a dye combination. In all cases, the comparative samples do not show an advantage and therefore have SPEED FACTOR values near 1.0. The inventive samples show and an advantage and have SPEED FACTOR values significantly greater than 1.0.

TABLE 1-5 below compares the photographic performance of the green sensitizing dyes GSD-1 through GSD-7 added singly or in combination as a function of spectral performance. Comparative sample 102 with only the single dye GSD-1 shows the highest relative spectral sensitivity at 530 nm verses that of all other dyes GSD-3 through GSD-7 individually. However, at a spectral sensitivity of 545 nm, the performance of sample 102 is significantly behind those of examples 104, 105 and 108 (use of GSD-3, GSD-4, and GSD-7 individually). When combinations of dyes are used, the performance at both 530 nm and 545 nm can be optimized as is shown in inventive sample 109. In sample 109, the combination of GSD-1 and GSD-3 shows the highest relative spectral performance simultaneously at 530 nm and also at 545 nm. Additionally, the enhanced spectral performance for this combination of dyes at both the 530 and 545 nm regions is obtained with a lower total quantity of dyes (each at $0.5\times10^{-3}$ moles) with respect to the singly added dyes having a total quantity of $1.0\times10^{-3}$ moles.

TABLE 1-5

| Sample Number (Inventive/ Comparative) | Dyes Used | Spectral Sensitivity (@ 2.0 Density) @ 530 nm | Spectral Sensitivity (@ 2.0 Density) @ 545 nm |
|---|---|---|---|
| 102 (Comp) | GSD-1 | 903 | 131 |
| 104 (Comp) | GSD-3 | 557 | 380 |
| 105 (Comp) | GSD-4 | 351 | 331 |
| 106 (Comp) | GSD-5 | 100 | 105 |
| 107 (Comp) | GSD-6 | 220 | 103 |
| 108 (Comp) | GSD-7 | 486 | 209 |
| 109 (Inv) | GSD-1/GSD-3 | 1571 | 407 |
| 110 (Comp) | GSD-1/GSD-4 | 611 | 219 |
| 111 (Comp) | GSD-1/GSD-5 | 369 | 100 |
| 112 (Comp) | GSD-1/GSD-6 | 1063 | 204 |
| 113 (Comp) | GSD-1/GSD-7 | 1277 | 263 |

Example 7

Multilayer Photographic Film Element

A multilayer film of this invention was produced by coating the following layers on a polyester (ESTAR) film support (each coverage is in g/m$^2$). Emulsion sizes are reported as mean equivalent spherical diameter in μm, with nominal cubic edge lengths in parentheses. Surfactants, coating aids, emulsion addenda (including 4-hydroxy-6-methyl-1,3,3a,7-tetraazaindene), sequestrants, thickeners, lubricants, and tinting dyes were added to the appropriate layers as is common in the art. Couplers and other non-water soluble materials were added as conventional oil-in-water dispersions as well known in the art.

Multilayer Photographic Film Format (ML-1):

Layer 1 (Antihalation layer): gelatin at 1.6, dye UV-1 at 0.05; antihalation dye AH-1 at 0.086.

Layer 2 (Slow cyan layer): a blend of two red-sensitized silver iodobromide emulsions: (i) a 0.07 μm, 3.35% I sensitized with a mixture of RSD-1 and RSD-2 at 0.30, (ii) a 0.07 μm, 3.35% I sensitized with a mixture of RSD-1 and RSD-2 at 0.10; cyan dye-forming couplers C-1 at 0.200, C-2 at 0.100; bleach accelerator releasing coupler B-1 at 0.006; masking coupler MC-1 at 0.060, and gelatin at 2.10.

Layer 3 (Mid cyan layer): a red-sensitized iodobromide emulsion sensitized with a mixture of RSD-2 and RSD-3, 0.11 μm, 3.35% I at 0.155; coupler C-1 at 0.200; coupler C-2 at 0.050; MC-1 at 0.056, and gelatin at 1.20.

Layer 4 (Fast cyan layer): a red-sensitized iodobromide emulsion sensitized with a mixture of RSD-2 and RSD-3, 0.13 μm, 3.35% I at 0.250; C-1 at 0.124; MC-1 at 0.005, and gelatin at 0.90.

Layer 5 (Interlayer): Interlayer Scavenger ILS-1 at 0.108; yellow minimum density dye YMD-1 at 0.009, soluble green filter dye GFD-1 at 0.02, and gelatin at 0.800.

Layer 6 (Slow magenta layer): a blend of two green sensitized emulsions (sensitized with a mixture of GSD-1 and GSD-3): (i) Emulsion E and (ii) Emulsion D; magenta dye-forming coupler M-1 at 0.355; magenta dye-forming coupler M-2 at 0.096; masking coupler MC-2 at 0.084, and gelatin at 1.25.

Layer 7 (Mid magenta layer): a blend of two green sensitized emulsions (sensitized with a mixture of GSD-1 and GSD-3): (i) Emulsion C and (ii) Emulsion D; magenta dye-forming coupler M-1 at 0.096; magenta dye-forming coupler M-2 at 0.079; masking coupler MC-2 at 0.045, and gelatin at 0.775.

Layer 8 (Fast magenta layer): a green sensitized emulsion (sensitized with a mixture of GSD-1 and GSD-3): Emulsion B; magenta dye-forming coupler M-1 at 0.032; magenta dye-forming coupler M-3 at 0.064; masking coupler MC-2 at 0.012, and gelatin at 0.600.

Layer 9 (Interlayer): ILS-1 at 0.108, yellow filter dye YFD-1 at 0.11, stabilizer S-1 at 0.005, and gelatin at 0.538.

Layer 10 (Slow yellow layer): A blend of two blue sensitized emulsions (sensitized with BSD-1): (i) 0.13 μm, 3.35 mole % I at 0.325, (ii) 0.17 μm, 3.35 mole % I at 0.044; coupler Y-1 at 1.070; MC-3 at 0.024; C-1 at 0.021; B-1 at 0.006, and gelatin at 1.622.

Layer 11 (Mid yellow layer): A blue sensitized emulsion (sensitized with BSD-1), 0.17 μm, 3.35 mole % I at 0.150; coupler Y-1 at 0.140, Y-2 at 0.032, MC-3 at 0.008, C-1 at 0.010, stabilizer S-2 at 0.007, and gelatin at 0.800.

Layer 12 (Fast yellow layer): A blue sensitized emulsion (sensitized with BSD-1), 0.27 μm, 3.35 mole % I at 0.075; coupler Y-1 at 0.075, Y-2 at 0.024, MC-3 at 0.011, stabilizer S-2 at 0.003, and gelatin at 0.800.

Layer 13 (Lippmann Layer): silver bromide Lippmann emulsion at 0.108; Stabilizer S-1 at 0.005, gelatin at 0.753 with hardener H-1 (bis(vinylsulfonyl)methane) at 1.4% of total gelatin weight streamed into this layer during application to the support.

Layer 14 (Protective overcoat): a blend of permanent and soluble matte beads and gelatin at 0.753.

Chemical structures for the materials used in the above layers are as follows:

UV-1

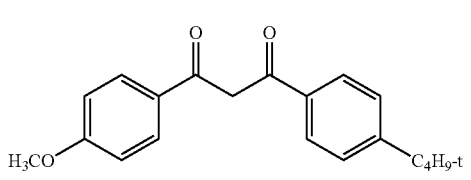

-continued
AH-1
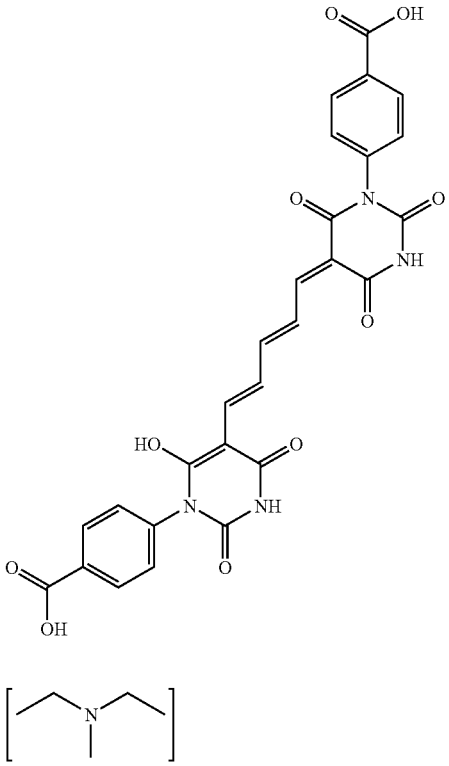
ILS-1
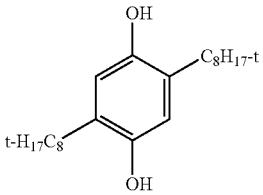
C-1
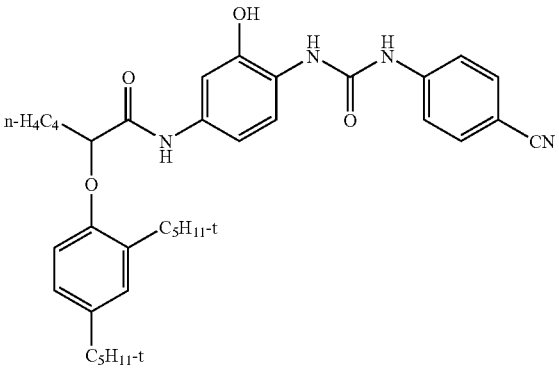
C-2
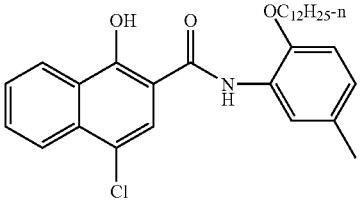
-continued
B-1
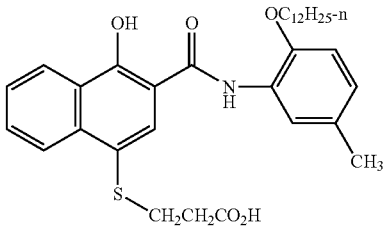
MC-1
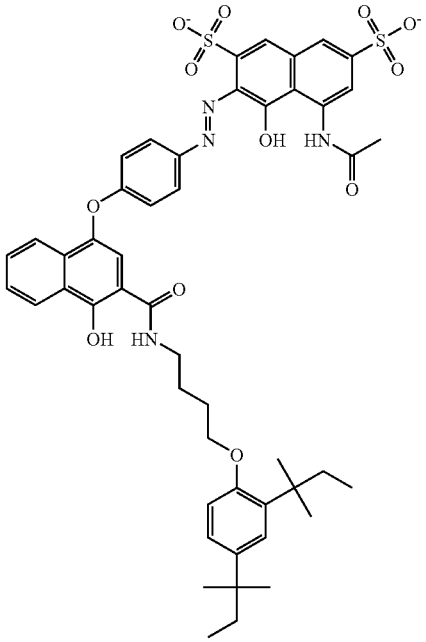
MC-2
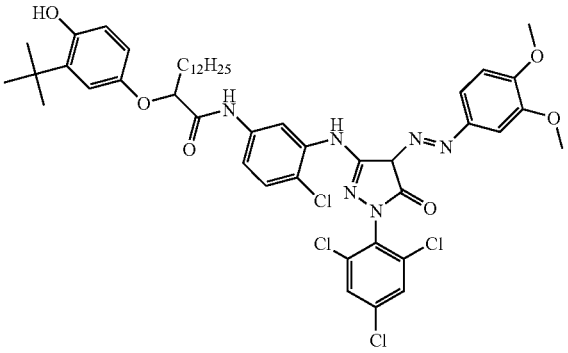

MC-3
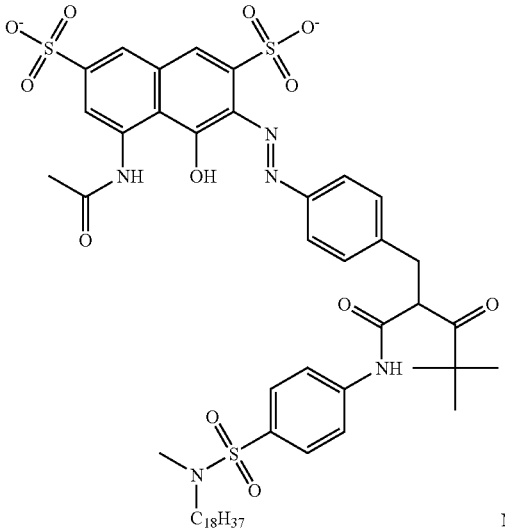
$Na^+ Na^+$
GFD-1
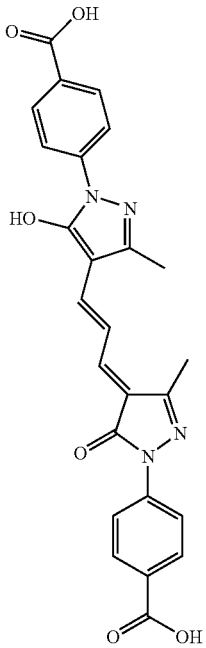
YMD-1
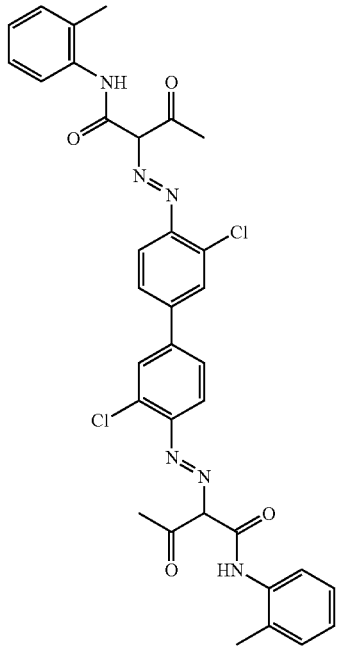
M-1
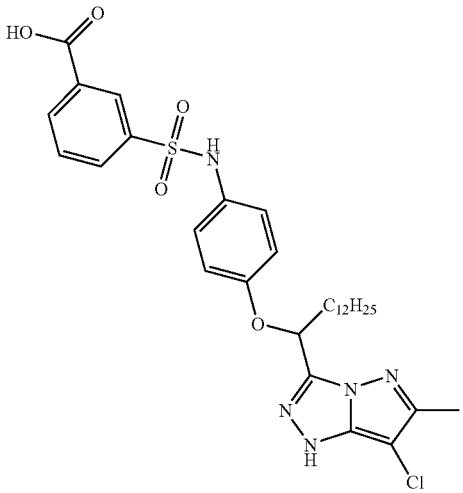

-continued
M-2
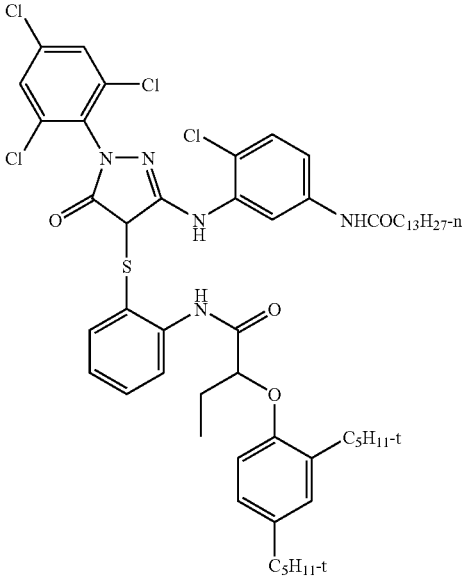
M-3
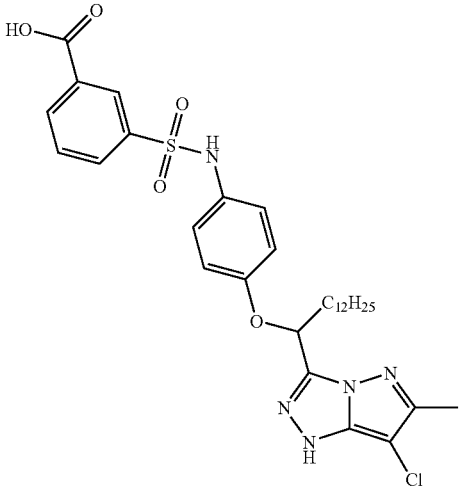
YFD-1
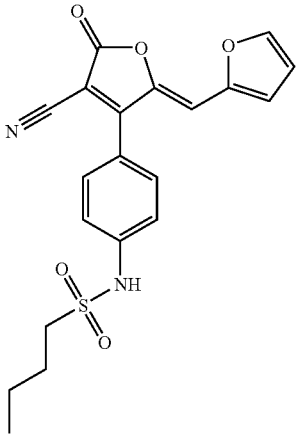
-continued
Y-1
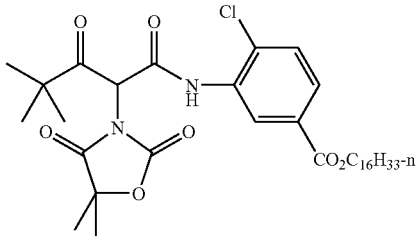
Y-2
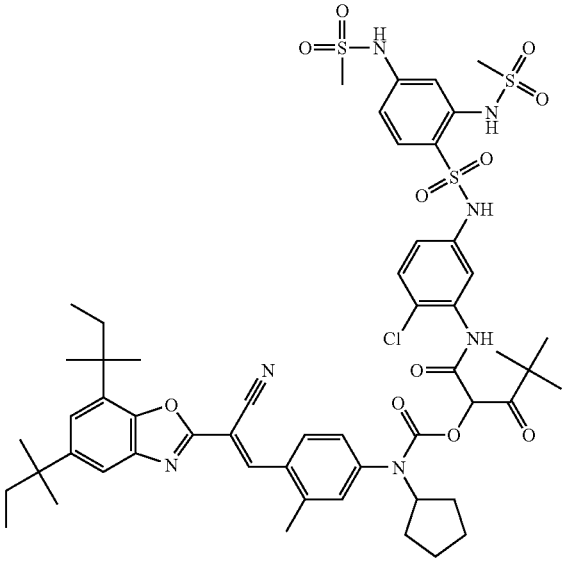
S-1
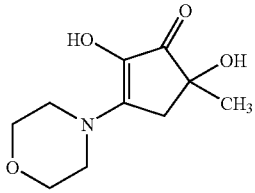
S-2
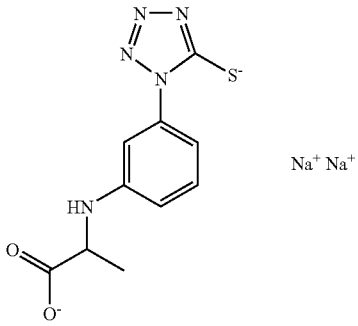

-continued
BSD-1
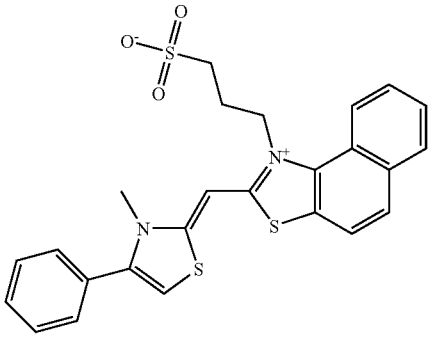
RSD-1
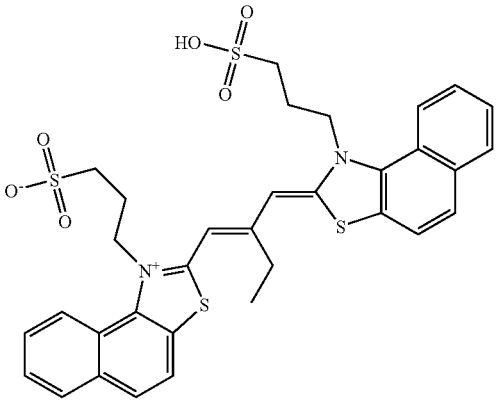
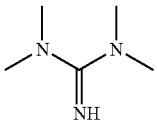
RSD-2
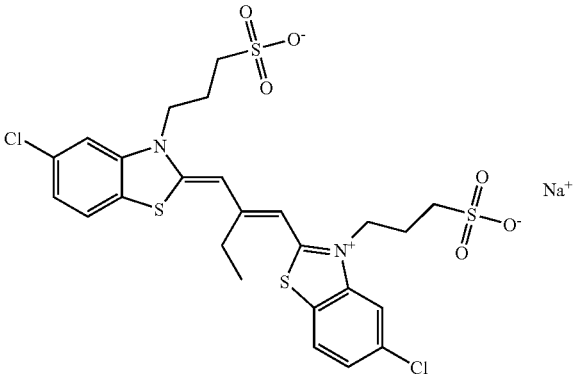
-continued
GSD-1
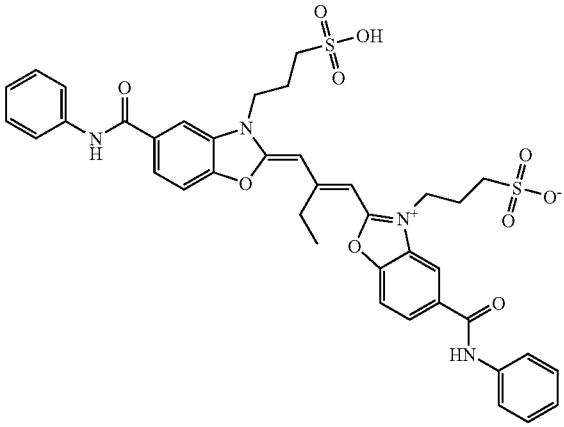
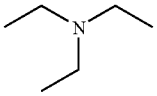
GSD-2
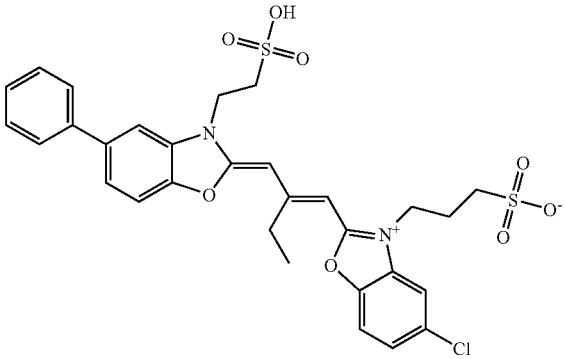
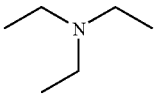
GSD-3
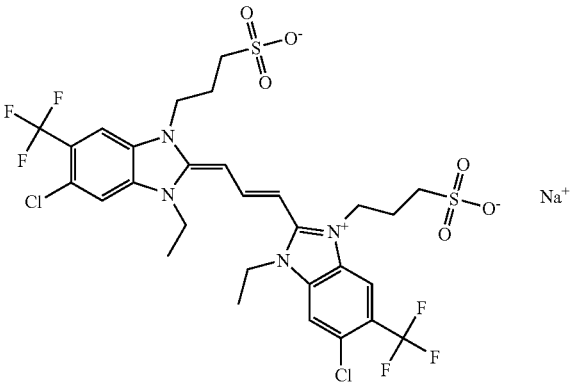

-continued

GSD-4

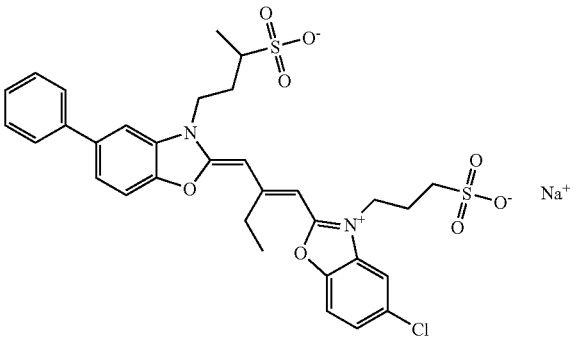

GSD-5

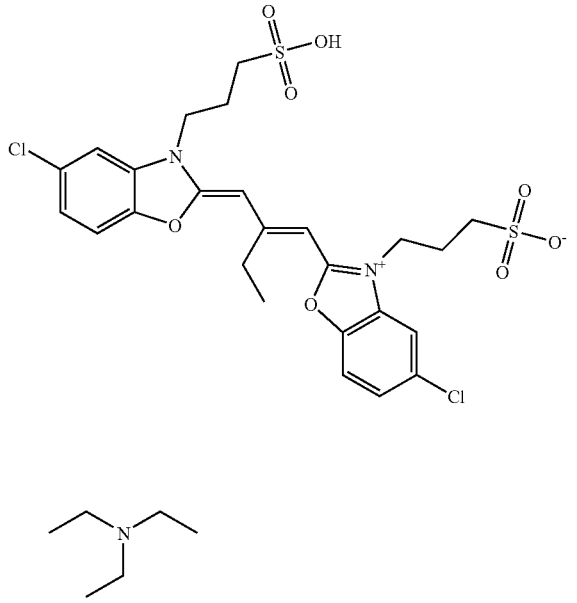

GSD-6

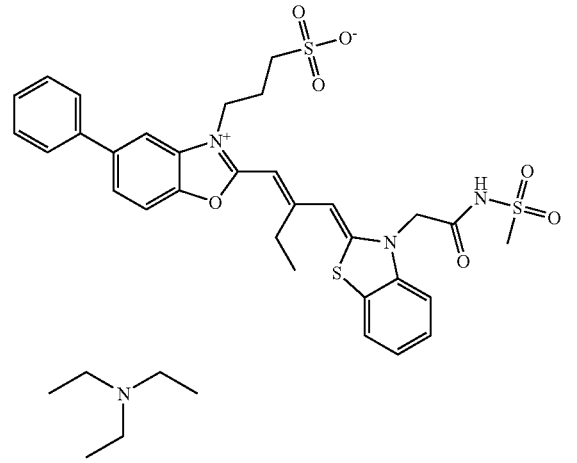

-continued

GSD-7

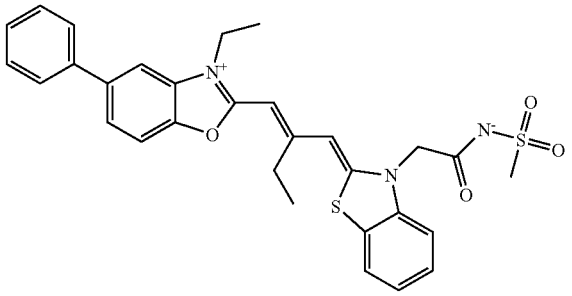

A sample of the above multilayer coating was given a neutral stepped exposure with a laser recording device (ARRILASER model HD/DI) featuring red ($\lambda_{max}$=660 nm), green ($\lambda_{max}$=532 nm), and blue ($\lambda_{max}$=460 nm) lasers. A second sample of the coating was exposed using a cathode-ray tube (CRT) recorder (CELCO FIRESTORM). The samples were then processed in the KODAK ECN-2 process. Red, green and blue densities were read using status M filters. Under both sets of exposure conditions, the multilayer element of the invention provided excellent speed, latitude, and maximum density in the green record. The ISO film speed for this intermediate motion picture film was determined to 0.5.

The invention has been described in detail with particular reference to certain preferred embodiments thereof, but it will be understood that variations and modifications can be effected within the spirit and scope of the invention.

The invention claimed is:

1. A silver halide photographic element that is a color intermediate motion picture film designed for exposure by laser radiation, the element having an ISO film speed of less than 1, and comprising a support having thereon:

a cyan dye image forming unit comprising at least one red sensitive silver halide emulsion, a magenta dye image forming unit comprising at least one green sensitive silver halide emulsion, and a yellow dye image forming unit comprising at least one blue sensitive silver halide emulsion, wherein the magenta dye image forming unit has at least one green sensitive silver halide emulsion layer that comprises predominantly cubic silver iodobromide grains having at least 90 mol % bromide, which grains have an average equivalent spherical diameter (ESD) of less than 0.25 μm, the green sensitive silver halide emulsion layer further comprising a first green sensitizing dye that is a cyanine dye having two oxazole groups in the molecule, and a second green sensitizing dye having either two imidazole groups in the molecule or one oxazole group and one thiazole group in the molecule, and the molar ratio of the first green sensitizing dye to the second green sensitizing dye is from about 4:1 to about 0.3:1.

2. The silver halide photographic element of claim 1 wherein the magenta dye image forming unit comprises at least two different green sensitive silver halide emulsion layers, a first emulsion layer that is arranged to be the first green sensitive silver halide emulsion layer that is exposed by imaging radiation and that has predominantly cubic silver iodobromide grains having at least 95 mol % bromide, and a second emulsion layer having predominantly cubic silver iodobromide grains having at least 95 mol % bromide, wherein the average ESD for both layers is less than 0.25 μm, but the average ESD for the first emulsion layer is greater than the average ESD for the second emulsion layer.

3. The silver halide photographic element of claim 2 wherein both first and second emulsion layers contain first and second green sensitizing dyes at a molar ratio that differs from each other by no more than 20%.

4. The silver halide photographic element of claim 2 wherein the cubic silver iodobromide grains in the first emulsion layer have an average ESD between 0.14 and 0.25 μm, and the silver iodobromide cubic grains in the second emulsion layer have an average ESD between 0.10 and 0.14 μm.

5. The silver halide photographic element of claim 4 wherein the magenta dye forming unit further comprises a third green sensitive silver halide emulsion layer that is closer to the support than the first and second silver halide emulsion layers, and that has predominantly cubic silver iodobromide grains having at least 90 mol % bromide and an average ESD between 0.06 and 0.12 μm.

6. The silver halide photographic element of claim 1 having an ISO film speed of from 0.1 to 0.7.

7. The silver halide photographic element of claim 1 wherein all of the green sensitive silver halide emulsion layers comprise predominantly cubic silver iodobromide grains having at least 95 mol % bromide.

8. The silver halide photographic element of claim 1 wherein all of the silver halide emulsion layers in all image forming units comprise predominantly cubic silver iodobromide grains having at least 90 mol % bromide.

9. The silver halide photographic element of claim 1 wherein the second green sensitizing dye is a cyanine dye having two imidazole groups in the molecule.

10. The silver halide photographic element of claim 1 wherein the first green sensitizing dye has a maximum absorption at a wavelength of from about 515 to about 540 nm.

11. The silver halide photographic element of claim 1 wherein the second green sensitizing dye has a maximum absorption at a wavelength of from about 530 to about 570 nm.

12. The silver halide photographic element of claim 1 wherein the molar ratio of the first green sensitizing dye to the second green sensitizing dye is from about 3:1 to about 1.5:1.

13. The silver halide photographic element of claim 1 wherein the first green sensitizing dye has a maximum absorption at a wavelength of from about 530 to about 534 nm, and the second green sensitizing dye has a maximum absorption at a wavelength of from about 559 to about 565 nm.

14. The silver halide photographic element of claim 1 wherein each of said first and second green sensitizing dyes have a substituted or unsubstituted methine chain having 3 carbon atoms in the chain, and the oxazole, imidazole, or thiazole groups are at opposite ends of the substituted or unsubstituted methine chain.

15. The silver halide photographic element of claim 1 wherein the magenta dye image forming unit comprises two or more green sensitive silver halide emulsion layers and at least one of each of the first and second green sensitizing dyes are located in each of the emulsion layers, at the same or different molar ratios.

16. The silver halide photographic element of claim 1 wherein the magenta dye image forming unit comprises two or more green sensitive silver halide emulsion layers and the same first and second green sensitizing dyes are located in each of the emulsion layers at the same molar ratio.

17. The silver halide photographic element of claim 1 wherein each of the first and second green sensitizing dyes is present individually in an amount of from about $5\times10^{-4}$ to about $1.5\times10^{-2}$ mol/m$^2$.

18. The silver halide photographic element of claim 1 comprising at least one of the following compounds GSD-1 and GSD-2:

GSD-1

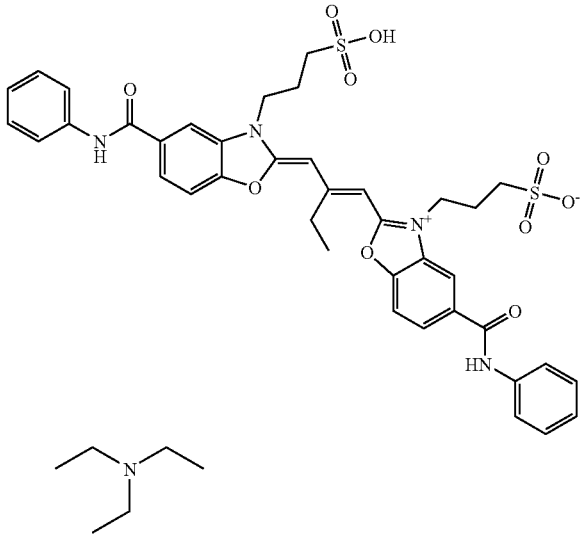

GSD-2

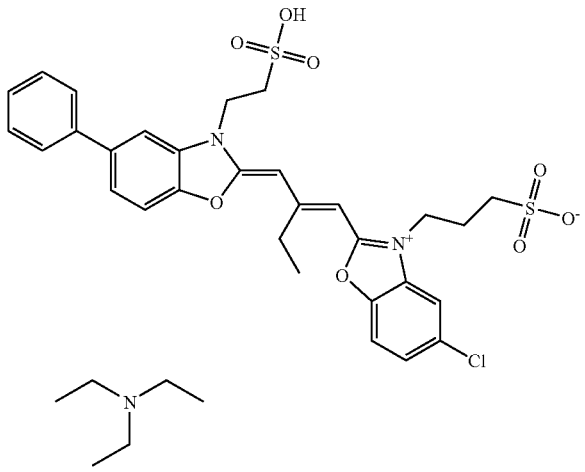

and further comprising at least one of the following compounds GSD-3, GSD-6, and GSD-7:

GSD-3

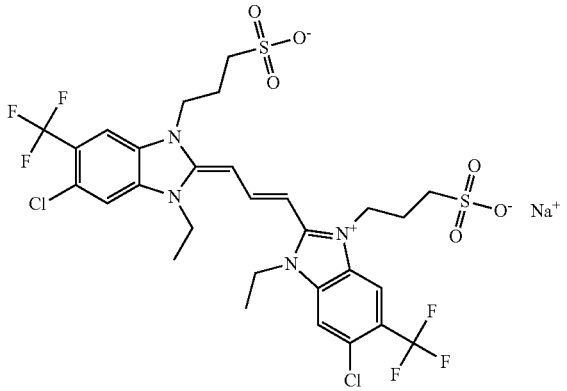

-continued

GSD-6

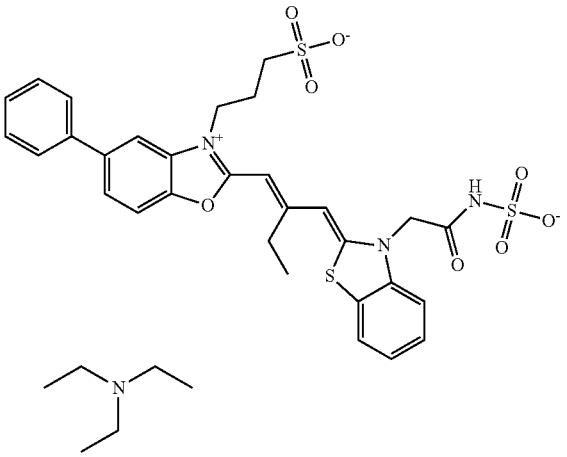

GSD-7

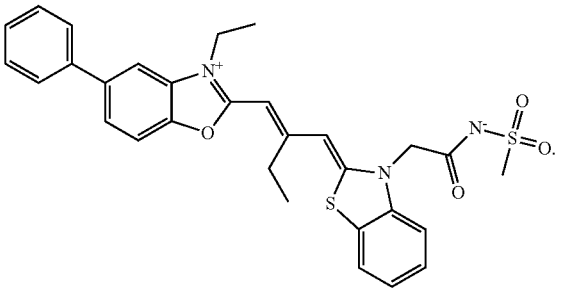

19. The silver halide photographic element of claim 1 that contains no development-inhibitor-releasing (DIR) compounds and no development-inhibitor-anchiomeric-releasing (DIAR) compounds.

20. The element of claim 1 wherein the at least one green sensitive silver halide emulsion consists essentially of only one first green sensitizing dye that is a cyanine dye having two oxazole groups in the molecule, and only one second green sensitizing dye having either two imidazole groups in the molecule or one oxazole group and one thiazole group in the molecule.

21. A method of providing a color image comprising:

imagewise exposing the color intermediate motion picture film of claim 1 to laser radiation provide a latent image, and developing the latent image in the presence of a color developing agent to provide a color image.

22. The method of claim 21 further comprising:

transferring the color image in the color intermediate motion picture film to a color motion picture print film.

23. The method of claim 22 wherein the color image is transferred by exposing the color motion picture print film through the imagewise exposed and developed color intermediate motion picture film.

* * * * *